United States Patent [19]

Van Laere

[11] Patent Number: 4,619,162

[45] **Date of Patent: * Oct. 28, 1986**

[54] HAND-HOLDABLE ELECTRIC POWER TOOL APPARATUS

[76] Inventor: Christiaan G. M. Van Laere, Rainstr. 86, CH-8038 Zürich, Switzerland

[ * ] Notice: The portion of the term of this patent subsequent to Mar. 19, 2002 has been disclaimed.

[21] Appl. No.: 594,797

[22] Filed: Mar. 29, 1984

Related U.S. Application Data

[63] Continuation-in-part of Ser. No. 430,763, Sep. 30, 1982, Pat. No. 4,505,170.

[51] Int. Cl.[4] ..... B25B 19/00

[52] U.S. Cl. ..... 81/464; 74/421 A; 173/104

[58] Field of Search ..... 173/117, 104, 12, 163; 74/421 A; 81/464

[56] References Cited

U.S. PATENT DOCUMENTS

| | | | |
|---|---|---|---|
| 2,771,786 | 11/1956 | Gilbert et al. | 74/421 A |
| 3,434,366 | 3/1969 | Raso et al. | 74/421 A X |
| 3,665,774 | 5/1972 | Bauhus et al. | 74/421 A X |
| 4,147,071 | 4/1979 | Scribiver et al. | 74/421 A X |
| 4,259,809 | 4/1981 | Mabuchi et al. | 74/421 A |
| 4,505,170 | 3/1985 | Van Laere | 81/464 |

*Primary Examiner*—E. R. Kazenske
*Assistant Examiner*—Willmon Fridie, Jr.
*Attorney, Agent, or Firm*—Heinrich W. Herzfeld

[57] ABSTRACT

An electric rotary power tool apparatus is adapted for loosening jammed or seized automobile wheel nuts or bolts and holdable by hand during operation. It comprises (1) an electric motor laid out to be driven by an electric direct current having an operational voltage of at least 8 to 30 volts and at least 20 up to 60 amperes, and comprising a stator, a rotor, first and second pole means, and a driving shaft bearing said rotor and having a rotary axis, the speed of said motor, at a nominal voltage of 12 to 24 volts ranging from 8000 to 30000 r.p.m. under load;

(2) a casing in which the motor is housed;

(3) an on-off and reversing switch;

(4) tool socket means being adapted for receiving a socket tool therein and comprising a driven shaft, the speed under load of which driven shaft is in the range of from 1200 to 4000 r.p.m.;

(5) a speed-reducing unit comprising a gear transmission positively and drivingly connecting the said driving shaft with the driven shaft and adapted for directly and uninterruptedly transmitting torque from the driving motor shaft to the driven shaft and reducing the speed of the former to the latter shaft in a ratio of from about 7:1 to about 12:1;

(6) impact-producing means comprising an impact mass separate from said motor and being associated with the tool socket means, mentioned under (4), supra, for imparting impacts to the latter means.

The apparatus can also be used as a hobby tool by eliminating the impact-generating unit.

5 Claims, 11 Drawing Figures

HAND-HOLDABLE ELECTRIC POWER TOOL APPARATUS

RELATIONSHIP TO EARLIER APPLICATION

This is a continuation-in-part application of my pending application Ser. No. 06/430,763 filed on Sept. 30, 1982, now U.S. Pat. No. 4,505,170.

BACKGROUND OF THE INVENTION

This invention relates to an electric rotary power tool apparatus, holdable by hand during its operation, and operated with the aid of an electric current from an automobile battery or similar current source. Power tool apparatus of this kind are known to be supplied with energy from an automobile battery of 6 or 12 volts.

In a first aspect the invention relates to novel power tool apparatus usable as impact wrench for the loosening of seized or jammed parts, in particular of bolts and nuts of automobile wheels. In a second aspect the invention relates to novel power tool apparatus adapted particularly for use in hobby work.

In U.S. Pat. No. 3,977,278 granted on Aug. 31, 1976 to John Van Jackson, there is described an automobile electric impact wrench comprising, in a housing, an electric motor the shaft of which carries a tool socket, cable means for supplying electric power to the motor and being provided with connector means for engaging the two terminals of an auto battery as well as switch means interposed between the cable means and the motor. This power tool apparatus also comprises an impact-inducing speed-reducing gear train off the planetary type and of intermittent or ratcheting action, but without an impactor mass other than that of the motor. While, in this known apparatus impact is induced in the speed-reducer, this would require a very strong and heavy motor, impacting after each ratcheting, in order to yield sufficient impacts on the tool socket for loosening bolts and nuts of an automobile wheel, in particular for exchanging tires.

This power tool apparatus of Van Jackson only carries a tool connected via the impact-initiating speed reducing gear train to the end of the driven shaft of the tool socket. In order to lay out the Van Jackson motor for dimensions permitting successful use as an impact wrench for loosening severely jammed or seized bolts or nuts of automobile wheels or like parts, the seize and weight of the motor would have to be excessively large and, moreover, such motor would produce such large amounts of heat that special cooling means for the motor would have to be provided which would further increase the cost and weight of the entire apparatus.

In order to carry out "hobby" work, for instance thread-cutting, drilling, impact drilling, cutting and the like Mitsubishi Electric Europe GmbH, in 4030 Ratingen(West), Germany has already described in a pamphlet published in July, 1981 a number of power tool apparatus having weights ranging from about 0.9 to 1.7 kilograms which are supplied with electric energy from nickel-cadmium batteries of 4 to 8 cells and a direct voltage of from 4.8 to 9.6 volts. Impact drills of this type have a frequency of 10,000 impacts per minute, and idling speeds of from about 250 to 1000 r.p.m. of the motor, and a torque of from 250 to 500 Newtoncentimeters (Ncm).

These apparatus, however, are relatively weak, and unsatisfactory for tightening or loosening heavy duty bolts and nuts such as are used in mounting automobile wheels of passenger cars or trucks (lorries) on their wheel hubs.

Such heavier duty work can, however, be carried out with impact wrenches manufactured by Robert Bosch GmbH, Leichterfelden, Germany, as published in a prospectus "Bosch Elektrowerkzeuge" of August 1981, in particular those of Types 1430, 1431 and 1432. Energy for these apparatus must however be supplied alternating electric current, taken from a city electric main, and having of from about 110 to 240 volts. These apparatus are much heavier than the "hobby types mentioned hereinbefore; they weigh about 3 to 8 kilograms. They have a speed of the driven shaft at full load of about 500 to 1000 r.p.m., an output of 165 to 360 watts and a tightening torque of about 180 to 800 Newtonmeters (Nm), corresponding to about 18 to about 80 meterkiloponds (mkp).

Of these known power tool apparatus, not even the last-mentioned, main-connected impact wrenches but only heavier impact wrenches which work with compressed air and thus require much more complicated arrangements including a compressor, may be able to solve the particular problems which arise in loosening jammed or seized bolts or nuts of automobile wheels when these parts have not been loosened for a long time and/or have been excessively tightened so that they have eaten into the material containing the threaded bores or bolts. Seizing of such parts may also be due to rust or dirt or the like causes. Moreover, switch means and speed control means of known types for the kind of power tool apparatus, dimensioned so that it could be connected to an auto battery or the like source of electric current, and which are laid out in accordance with known techniques, are very large und unwieldy.

Moreover, the versatility of the known hand-held apparatus is not very great being essentially limited to normal and emergency work on automobiles, and in particular as impact wrench, and whereas the known apparatus is configured to supply sufficient electric torque to serve as an impact wrench while being operated with electric current from a car battery, no switches and no speed control means have thus far been described to my knowledge that would not be of excessive size and weight for reasonably comfortable handling.

Thus, conventional on-off and reversing switches laid out for a direct current electro-motor operated by electric direct current of the initially mentioned characteristics, especially when of the permanent magnet type, would be far too large to be housed in the handle of a power tool apparatus and also be far too heavy to be held comfortably by the user's hands during use. Unless such switches of known type and involving, for instance, magnetic coils, are built too large and of relatively heavy parts, there would be danger of overheating of the switch, resulting in decrease and/or irregularities in the power output of the motor, and possibly even melting of wires in the switch.

There has also appeared on the market in the United States a 12 volt-impact wrench, Model No. 9518, sold by Black & Decker (U.S.) Inc. Raleigh, N.C. 27625. This impact wrench is destined to be connected with a 12 volt battery. The specifications given are: 12.6 volt D.C., 19 amps, up to 100 ft. lbs. (136 Nm) of torque, ½ in. square drive, 1100 impacts (revolutions?) per minute, forward/reverse switch, 17 ft. cord, ball & sleeve bearings. This impact wrench has a net weight of 7⅝ lbs. and is said to be usuable with an average size battery in good condition. As far as I know this impact wrench represents the closest prior art and has therefor been used in. Its comparative tests to be described further below its speed-reducing ratio is 15:1.

OBJECTS AND SUMMARY OF THE INVENTION

It is therefore a principal object of the invention to provide an electric rotary power tool apparatus of the initially-described type which is capable of loosening even seriously jammed or seized bolts, nuts or the like parts, while having at most the same or preferably less weight than the known types of impact wrenches, and which is adapted for having the required energy supplied from an auto battery or the like current source supplying a direct electric current having a voltage in the range of from about 8 volts and up to maximally 30 volts, and a power input to the motor of at least 20 amperes and up to 40 to 80, and even higher, e.g. up to 180 amperes, corresponding to 180 watt and higher.

It is another important object of the invention to provide a power tool apparatus as described and satisfying the requirements of the preceding objects, which apparatus does not require special heat-dissipating means, due to the fact that the motor of the apparatus will not overheat and/or the normal heat transfer of the apparatus casing suffices to dissipate satisfactorily all excessive heat generated by the motor.

It is also an object of the invention to provide improvements in the initially described, preferably easily hand-holdable electric power tool apparatus operable with the aid of a direct electric current from a car battery or the like electric direct current source as defined above, and preferably free from special cooling means, which permits use therein of a motor of high output and small size, and wich can be used for hobby work, such as drilling or other shape-changing operations.

In order to prevent generation of excessively high reaction forces (which would exceed the strength of the operator holding the apparatus), the impact mass is urged by means of a spring against slightly sloped contact faces of the driven tool socket. The strength of the spring and the taper of the contact faces assures a continuous tightening or loosening of bolts and the like elements up to the moment when the reaction forces cause the impact mass to slip over a first sloped contact face and abut against the next following sloped contact face. The impact action only starts when the reaction forces surpass 50 Newtonmeters.

These and other objects of the invention that will become apparent in the following description thereof, are achieved in a power tool apparatus of the aforementioned kind which, in accordance with the invention, comprises (1) an electric motor comprising (a) a stator, (b) a rotor having a longitudinal rotor axis, (c) first and (d) second stationary contactor means, (e) a driving rotor shaft bearing said rotor, and (f) a motor housing containing in its interior said stator and rotor and comprising a surrounding hull, a forward end wall and a rearward end wall;

(a) the stator being mounted in the interior of the housing in the hull and being a permanent magnet of magnetic iron material, the permanent magnet comprising a north pole shoe and a south pole shoe of substantially semicylindrical configuration and having each thickness of from about 5 to 6 mm, the pole shoes of the permanent magnet being concentrical with the longitudinal rotor axis; and opposite longitudinal gaps having each a circumferential width, in a radial plane, of about 33 mm and separating said two pole shoes from one another; the length of said permanent magnet being from about 30 to 65 mm; and the radial diameter of the assembled rotor and two pole shoes taken together being from about 42 to 45 mm;

said rotor consisting essentially of (i) a generally drum-shaped armature on the rotor shaft and having a substantially cylindrical surface section coaxial with the longitudinal rotor axis and with an external diameter of about 32 mm and a length of from about 26 to 55 mm, the armature having 12 axially extending cut-out channels parallel with the longitudinal rotor axis and opening out of the external surface section of the armature the internal diameter of said armature between the deepest ends of every two diametrically opposite cut-out channels being from about 16 to 17 mm, (ii) a wiring of electrically conductive wire having a diameter of each individual wire cross section of from about 0.56 to 0.72 mm and comprising a plurality of wire portions, each of the channels containing about 30 to 37 of the wire portions, and (iii) a collector comprising 12 collector segments and being mounted on the rotor shaft, the total length of wire amounting from about 12 to about 24 meters;

the collector comprising brush means for collecting positive and negative electric current from the collector segments and being disposed in contact with the collector inside said motor hull, and the first and second stationary contactor means being electrically conductively connected with the brush means and extending from the latter toward the rear end wall of the motor hull and extending through the rear end wall to be contactable from the outside thereof;

(2) a casing to which the motor is attached, comprising base part means adapted for being carried by the user's hand, (3) a speed-reducing unit in the casing and comprising a gear transmission having an input side positively and drivingly connected to the driving motor shaft, and an output side, and being adapted for directly and uninterruptedly transmitting torque from the driving motor shaft to the output side:, (4) a driven shaft connected to the output side of the speed-reducing unit;

the speed-reducing unit reducing the speed of the driving shaft to that of the driven shaft in a ratio of from about 7:1 to about 12:1;

the rotor shaft being rotatably mounted in the foreward end wall of the motor housing and having a free end connectable to the input side of the speed-reducing unit, the rotor shaft and the collector thereon being housed in a zone of the surrounding hull between the end wall, the motor housing and an end of the wiring facing toward the rear end wall;

(5) an impact-generating unit connected to the driven shaft for rotation therewith, and (6) tool socket means being adapted for receiving a socket tool thereon and connected with the impact-generating unit;

(7) an on-off and reversing switch being adapted for switching a direct electric current having an electric potential from 8 to 30 volts and an amperage sufficient for according a power input of the motor of 180 watt and, under load, of 620 watt;

the on-off reversing switch comprising supporting cover means, spaced from and pivotally mounted on an external face of the rear end wall of the motor housing and having an inner and an outer face both extending substantially transversely to the longitudinal rotor axis;

a pair of shiftable contactor means mounted in the cover means and extending from outside the outer face thereof through the cover means and protruding from the inner face thereof toward the rear end wall of the motor housing, the cover means having passage means for the introduction of a pair of lead means from a plus pole and a minus pole, respectively of an automobile battery into the inter-space between the rear end wall and the inner face of the cover means, and into electrically conductive engagement with a first and a second one, respectively, of the pair of shiftable contactor means, the shiftable contactor means being so disponed in the cover means as to be switched by corresponding turning of the cover means to adopt three different positions, in a first "off" one of which, parts of the shiftable contactor means at the inner face of the cover means are out of contact with both the first and second stationary contactor means, while in a second position, a first one of the shiftable contactor means makes contact with the first stationary contactor means lodged in the rear motor housing end wall on the outside thereof, and the second shiftable contactor means makes contact with the second stationary contactor means also on the outside of the rear end wall, thereby activating the motor for rotating the driving shaft in a given direction of rotation, and, in a third position, the second one of the shiftable contactor means makes contact with the first stationary contactor means, and the first shiftable contactor means makes contact with the second stationary contactor means, thereby reversing the direction of rotation of the motor and the driving shaft, and the impact-generating unit comprising an anvil having least two anvil abutments, a hammer drum and at least two hammers thereon, the drum and hammers weighing together about 350 to 550 grams and having a radial diameter of about 50 to 55 mm; a hammer shaft connected with the driven shaft, said hammer drum being axially displaceable along the hammer shaft; and a drum spring supported in the impacting unit to urge the hammer drum and hammers into a position in which the hammers are enabled to impact upon the anvil abutments when the hammer shaft is rotated; the hammer drum spring having a length, measured along the rotor axis, of about 35 to 45 mm, and the compressibility of the hammer drum being 10 mm under a load of about 18 to 22 kg.

Preferably, the commutator brushes feeding direct electric current to the collector segments of the electric motor are connected to contactor blades, studs or the like means, and these protrude at some point from the motor housing, preferably from the motor rear end.

Terminal posts conductively connected to the pole shoes of a direct current source, e.g. a car battery, are connected to shiftable contact buttons or the like contactor elements in a shiftable or turnable switch member. When this switch member is in the OFF-position contact of at least one of the contactor buttons or the like elements with at least one of the contactor blades or the like means on the motor housing is interrupted. Preferably, contact of all contactor buttons and contactor blades is interrupted. In the ON-position, contact will be established between all contactor elements and shiftable means, in a first position for clockwise rotation, and in a second, reverse position for counter-clockwise rotation of the motor armature and the motor driving shaft.

All measures are taken to ensure a minimum of resistance losses in the paths of direct electric current between the current source and the collector segments of the motor armature. Thus, the cables 121 and 122 used to connect the +pole and the −pole of the battery with the corresponding connecting pin elements of the switch 40 preferably comprise a parcel of fifty wires each being 0.25 mm thick, the parcel having a diameter of 2.5 mm, when a normal car battery is being used, while, in the case of a truck (lorry) battery the parcel has a diameter of about 3 mm and consists of fifty wires each having a thickness of 0.38 mm.

The electric motor is preferably devised to be fed an electric direct current from an automobile battery having a nominal voltage of 12 volts and an operational voltage of at least 10 volts, a power output of at least 250 watt and the idling speed of the motor at the voltage ranges from about 10,000 to 25,000 r.p.m., the transmission ratio is 7:1 to 12:1 and the driven shaft has correspondingly an idling speed of above 1200 and up to 4000 r.p.m., and preferably a speed from about 1200 to 2200 r.p.m.

Most preferred is an idling speed of the motor of from 13,000 to 15,000 r.p.m.

It would have been expected that such high speed which means less strength of the motor, would be too weak and therefore fail to loosen severely jammed or seized bolts or nuts when a speed of 7000 r.p.m. would fail if the motor receives its direct current from a 12 volt-automobile battery.

When the energy is supplied to the power tool apparatus according to this second invention aspect from a 12 volt-automobile battery, then the speed of the driving motor shaft, at the nominal voltage of 12 volts, should at least be 4000 r.p.m. under full load.

The amperage of the power source (preferably a car battery of 12 or 24 volts) delivered to the tool apparatus are to the invention under load should be preferably at least 20 and preferably 125 up to 150 amperes, and from 180 amperes up to 300 to 400 amperes.

I have found the above-mentioned transmission ratio of from about 7:1 to 12:1 to be critical, because below and above that ratio, even though the resulting speed of the driven shaft in about 1200 to 4000 r.p.m., the apparatus will fail to loosen severely jammed or seized bolts or nuts of automobile wheels in an increasing number of cases, the greater the difference from the above-stated range of ratioes. The choice of the transmission ratio is dependent on the idling speed of the driven shaft of the motor; thus, when that idling speed is 30,000 r.p.m., a transmission ratio of 12:1 is preferred. If a ratio of 7:1 were used, a flywheel effect might be produced by the impact mass and the impact-generating unit would be no more effective and might even be damaged.

In order to provide a successful power tool apparatus according to this second invention aspect, the same must further comprise impact-producing means comprising an impact mass separate from said motor and being associated with the tool socket means, mentioned under (4), supra, for imparting impacts to the latter means.

These impact producing means comprise an impact mass and preferably impart impacts to the tool socket means at a frequency equal to the number of revolutions per minute carried out by the driven shaft.

Automobile batteries have usually a nominal voltage of 12 volts, for passenger cars and 24 volts for trucks, lorries, buses, agricultural combustion engines and the like. The electric motor can therefore also be fed with D.C. from a 24-volt battery (operational voltage at least 20 and up to 28 volts).

In a further aspect of the invention, the electric motor is preferably laid out to be driven by an electric direct current having an operational voltage below 20 volts and, in particular, of about 9.5 to 14.5 volts; the speed of the said electric motor, at a nominal voltage of 12 volts, should preferably not exceed 15,000 r.p.m. when idling.

Such power tool apparatus of the initial type having an electric motor of the last-mentioned characteristics is useful in particular for hobby word such as drilling, honing, super-finishing, fine-grinding, milling and the like operations which serve to change the shape of an article of metal or synthetic resin material in some desired way.

The power tool apparatus according to this aspect of the invention is preferably obtained by removing the impact-generating unit from the apparatus, thus leaving an apparatus comprising only the motor and the speed-reducing unit adapted for transmitting torque at a reduced speed to the tool socket means.

Preferably, the electric motor has a rear end face turned away from the tool socket means, and an on-off and reversing switch is mounted in the casing at the rear end of the motor, and the pole means of the motor protrude from the rear end face thereof.

BRIEF DESCRIPTION OF THE DRAWINGS

Further objects and advantages of the invention will become apparent from the following more detailed description thereof in connection with the accompanying drawings in which.

DETAILED DESCRIPTION OF THE DRAWINGS

Figure 1:
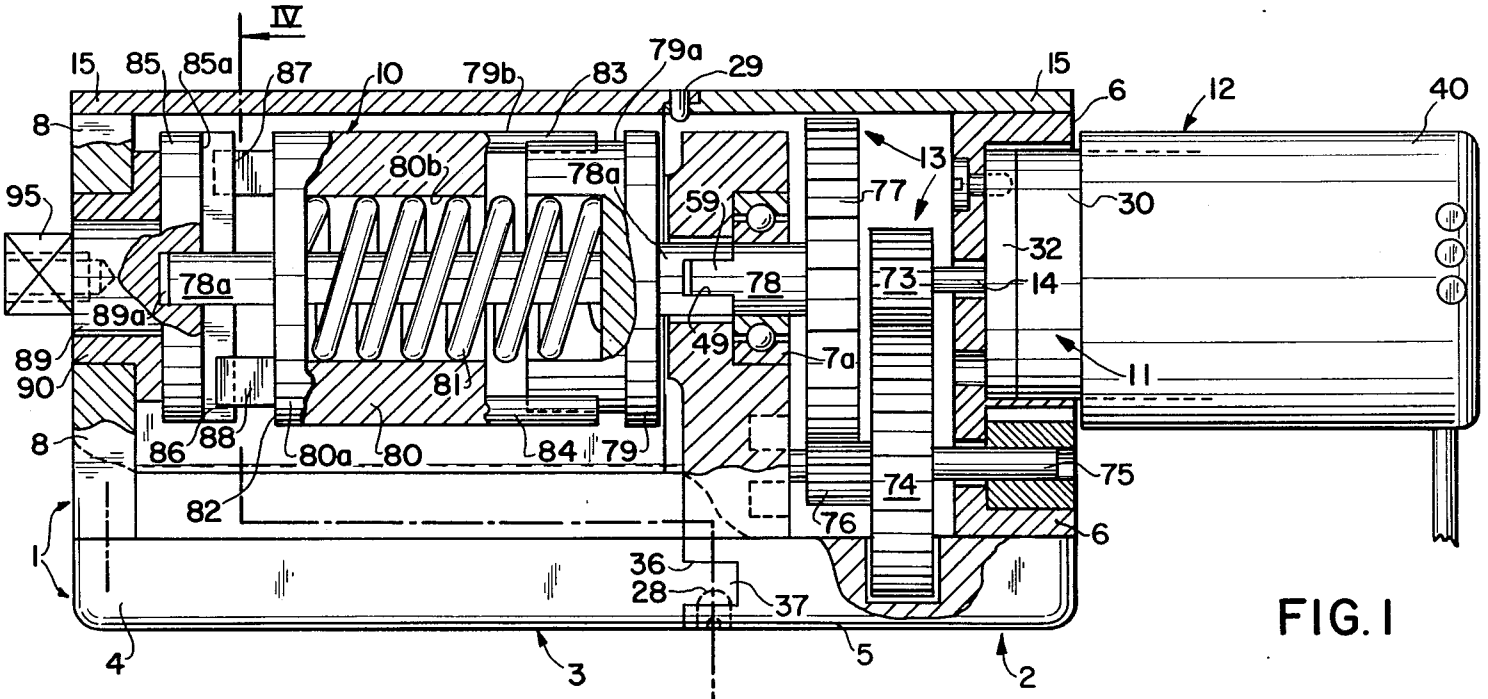
FIG. 1 is a sideview, partially in axial section, of a preferred embodiment of a power tool apparatus according to the invention usable as an impact wrench and convertible for use as a hobby tool apparatus.

In the preferred embodiment of a power tool apparatus shown in FIG. 1, a casing 1 consists of a rearward base part 2, a forward base part 3 and a cover 15. The base part 2 consists of a bottom plate 5 and upright walls 6 and 7. A motor unit 11 is firmly supported in the upright wall 6, and a speed-reducing unit 13 is supported in the upright wall 6.

The forward base part 3 comprises a bottom plate 4 and a forward upright wall 8.

Between the upright walls 7 and 8, there is rotatably supported an impact generator unit 10.

Figure 2:
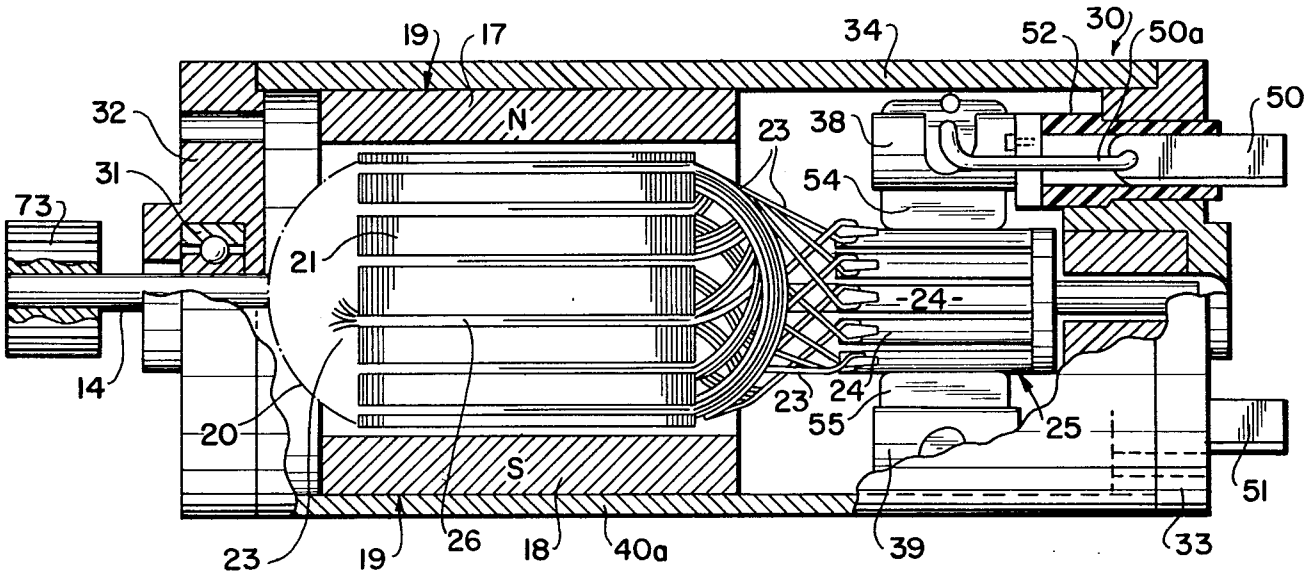
FIG. 2 is a detailed view, with most parts in axial section, of the motor unit of the embodiment shown in FIG. 1.
Figure 3:
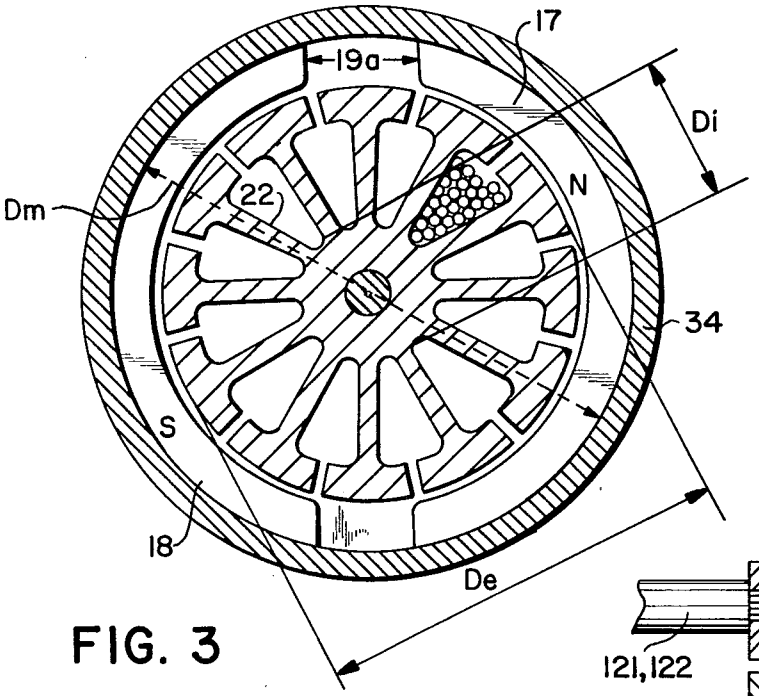
FIG. 3 is a cross-sectional view of the same embodiment taken in a plane indicated by III—III in FIG. 2.

The motor unit 11 is shown in more detail in FIGS. 2 and 3. The unit comprises an electric D.C. motor which comprises a generally drum-shaped armature 20 composed of forty lamellae 21, each consisting of about 0.65 mm thick sheet iron plates having an external diameter $D_e$ of 32 mm, which are arranged in parallel to form a package having an overall length L of 26 mm (FIG. 2). Each lamella 21 has in its outer annular zone twelve radial lamella cutouts 22, and the internal diameter $D_i$ of the lamella between the deepest ends of two diametrically opposite cutouts 22 is 16.7 mm. The lamellae 21 in the stack thereof forming the armature 20 are superimposed upon each other so that the cutouts register with one another and form twelve axially extending channels 26 in the external surface of the armature 20. Each of these channels houses portions, shown in cross section only in a single cutout 22 for the sake of clarity, of a hard copper wire 23. This copper wire has a diameter of 0.56 mm. Windings of this copper wire are wound about the armature in loops, so that 32 wire portions fill each of the channels 26, each loop consisting of two such portions and having a length of about 60 to 70 mm, i.e. a bit more than double the length of the armature. The wire windings are formed by pieces of wire having a length of about one meter, so that each such piece of wire can be wound in about sixteen loops from the rear end of the motor about the armature 20 through the channels 26 of the latter. The two free ends of each piece of wire are soldered to different collector segments 24 of a collector 25 which is mounted fixedly on a driving shaft 14 in common with the armature 20 for rotation in unison therewith.

As there are twelve pieces of wire having a total of 24 free wire ends, twelve collector segments 24 are provided in the collector 25, the whole constituting a two-pole drum-winding having a total length of twelve meters of wire of about 12 meters. The total number of wire portions in the twelve channels which should be shown in FIG. 3 would be 384.

The driving shaft 14 is supported in roller or ball bearins 31 which are mounted respectively in the frontal end wall 32 and the rear end wall 33 of a motor housing 30. The latter is in turn held firmly in the upright wall 6 of the apparatus casing 1, as shown in FIG. 1.

The casing 1 further comprises a cylindrical hull 34 which bears in its interior firmly attached to its inside wall the north pole shoe 17 and the south pole shoe 18 of a permanent magnet 19 of magnetic iron which have a length, in axial direction, of 31 mm and a radial thickness of 5.5 mm. The general arrangement of permanent magnet and armature is well known and illustrated in FIG. 150 of chapter "Gleichstrommaschinen" in "Elektrotechnik" by A. Däschler, a text-book published in 1968 by Verlag Aargauer Tagblatt AG in Aarau, Switzerland, However, as indicated in FIG. 152 of the same publication, the armature diameter is expected to be about 600 mm instead of the 32 mm of our novel D.C. motor. While the D.C. motor, according to FIG. 152 of the Däschler-textbook affords 280 kilowatts (kW) at 1470 r.p.m., our motor affords under load 0.6 kW at about 3700 r.p.m.

Electric motors of electric power-operated impact wrenches which are presently available in the market and are capable of loosening jammed or seized nuts or threaded bolts of automobile wheels for the purpose of changing automobile tyres must derive their power from an electric main, e.g. of 220 to 240 volts of A.C.

Several impact wrenches of this type have been described under the heading "Schlagschrauber" in the publication "Bosch Elektrowerkzeuge, Programm 1980/81 in August 1980, by Robert Bosch GmbH, D-7022 Leinfelden-Echterdingen, Germany. Depending on the size of the bolts to be loosened, e.g. of 16 mm diameter for passenger car wheels, the motor operates under full load with a speed of 1000 r.p.m., it has a power input of 320 Watt (about 1.5 Amp.) and a power output of 165 Watt and a tightening torque of 180 Newtonmeters (Nm), the wrench has a weight of 3 kilograms.

For heavier bolts of 22 mm diameter, the wrench is equipped with a motor operating at 725 r.p.m. under full load, with a power input of 420 Watt, (about 1.9 amperes) a power output of 200 Watt, and a tightening torque of 300 Nm; the wrench weighs about 5.3 kg.

Screws having a diameter of 27 mm can be loosened with a wrench whose motor penetrates at a speed of 540 r.p.m. under full load, with an input of 620 Watt (2.8 amperes), an output of 360 Watt, and a tightening torque of 800 Nm; this wrench weighs 8.3 kg.

In contrast thereto, the above-described electric motor in our preferred embodiment operates at a speed under full load of 2000 to 2800 r.p.m., with a power input of about 300 to 450 Watt (25 to 40 amperes) and a power output of about 250 Watt, and a loosening torque up to 800 Nm (25 amperes and higher); the apparatus has a weight of maximally 3 kg, and even less, while it is fed by a D.C. of 12 volts (operational voltage of about 10 to 14 volts) as supplied by a common automobile battery. When connected to a heavy automobile battery of 24 volts, it operates under full load with a speed of 4000 r.p.m.

A speed is majored under full load when the tool socket is momentarily blocked and the impact mass hits upon the impact abutment in the impact unit. In this case the speed of Motor A drops from the idling speed of 15,000 r.p.m. to a speed under full load of 2800 r.p.m. corresponding to a speed of the driven shaft with continous impacts of 400 r.p.m. when the Motor A is used in an impact wrench according to the invention having a speed reduction ratio of 7:1, and to a speed of 235 r.p.m. when the impact wrench has a speed reduction ratio of 235 r.p.m. The motor then draws a current of about 75 amperes from the 12 volt battery, i.e. a power of about 800 watts, when loosening exessively tightened bolts or nuts of automobile wheeles. The power input required by the motor when the tool socket and the driven shaft idle and the motor shaft rotates at a speed of 14,000 r.p.m., is about 18 watt, corresponding to about 7 amperes when the battery has a potential of about 11.4 volts, when the speed reducing ratio in the impact wrench is 12:1. When tis ratio is 7:1 the idling speed of the motor shaft was found to be 12,600 r.p.m., the power consumtion was 74 watts, corresponding 6.4 amperes of current drawn from a battery having a potential of 11.56 volts.

Old batteries having no longer the full potential of 12 volts were used in order to test the capabilities of the impact wrench according to the invention under less than optimal conditions.

In the following table there are given data for two preferred embodiments A and B of the electric motor to be used in the power tool apparatus of the invention:

| | Motor A | Motor B |
|---|---|---|
| | (in mm) | |
| (1) Length of straight winding portions on armature | 26.7 | 50 |
| diameter of armature with winding | 32.2 | 32.2 |
| (2) diameter of armature wire | 0.56 | 0.72 |
| (3) length of each magnet pole shoe (N or S) | 31 | 64 |
| (4) thickness of magnet pole shoe (N or S) | 5.5 | 5.5 |
| (5) internal width 19a between magnet pole shoes | 33 | 33 |
| (6) diameter of motor shaft | 5.0 | 5.0 |
| (7) diameter of commutator | 15.0 | 15.0 |
| (8) diameter of assembled armature and two pole shoes (Dm) | 43 | 43 |
| | (r.p.m.) | |
| (9) motor shaft idling speed connected to 12 Volt battery | 15000 | 8000 |
| (10) motor shaft idling speed connected to 24 Volt battery with 12:1 transmission: | 28000 | 15000 |
| (11) bolt loosening strength connected to 12 Volt battery | 250 Nm* | 60 Nm* |
| (12) bolt loosening strength connected to 24 Volt battery *wrench width over flats of 16 mm. | >300 Nm* | >250 Nm* |
| wrench width over flats of 27 mm. | ≧400 Nm | ≧300 Nm |

The fully satisfactory results obtained with the preferred embodiment of the power wrench according to the invention are particularly unexpected as it would have been obvious to provide a slower motor of less full load speed and higher power input and output the severer the jamming or seizing of the screw to be loosened (see the Bosch motors described above).

I have discovered unexpectedly that the opposite is true and that a "weaker" motor operating at higher speed under full load can do the same job successfully even though it is fed with direct electric current of low voltage, e.g., 12 or 24 volts of an automobile battery.

The small size, low weight and high speed of the abovedescribed motor used in the preferred impact wrench according to the invention is comparable only to those of compressed air motors as they are known to be used in Atlas Copco wrenches (see the publication "Schrauber" by Atlas Copco Aktiebolag, Nacka, Sweden, in November 1971). However, these wrenches are destined only for screws having a diameter of about 5 to 8 mm, and are therefore unsuitable for tightening or loosening screws or bolts of automobile wheels. The same is true for the Mitsubishi hobby impact tool apparatus, in particular drills, driven by small motors as described hereinbefore.

In attaining the objects of the invention I have found the following features described hereinafter to be also critical, i.e. the high speed of the weaker motor is only one of several criteria I had to observe in achieving the above-stated main object.

Thus, I have found that the speed reduction ratio of the driving to the driven shaft in the speed reducing unit is highly critical in order to achieve the object of loosening severely jammed or seized screws, bolts or nuts of the type used for mounting automobile wheels on their hubs. This speed reduction ratio should be in the range of from about 12:1 to about 7:1, the ratio of 7:1 being the preferred one when the apparatus is operated with D.C. drawn from a 12 volt-automobile battery.

The preferred type of speed-reducing unit 13 shown in FIG. 1 comprises a train of spur gears consisting of a small driving gear 73 mounted on the driving motor shaft 14 for rotation therewith. I have found it advantageous to use a gear having a diameter of 14 mm and bearing twelve cogs or teeth. This gear 73 engages another larger spur gear 74 which is mounted fixedly on a gear shaft 75 being rotatably mounted in upright casing walls 6 and 7. The spur gear 74 has advantageously a diameter of 44 mm and 42 cogs. On the same shaft 75 there is fixedly mounted, on the side of the gear 74 turned away from the motor unit 11, a smaller spur gear 76 having a diameter of 18 mm and 16 cogs. This gear 76 which rotates, of course, at the same speed as the gear 74 engages a larger spur gear 77 which is mounted on a driven shaft 78/78*a*, having a separable forward extension 78*a* rotatably supported in the frontal upright end wall 8 of the apparatus casing 1. The spur gear 77 has a diameter of 34 mm and bears 32 cogs. This results in a transmission ratio of the speed of the driving shaft 14 to that of the driven shaft of 7:1. The speed of the driven shaft is then 1957 r.p.m. if that of the driven shaft under full load is 13700 r.p.m.

The desired objects of the invention are also fulfilled if the following gear trains are used as speed-reducing unit 13; based on a full load motor speed of

| Gear | Diameter (mm) | Cogs (number) | Speed ratio and Speed of driven shaft r.p.m. |
|---|---|---|---|
| 273 | 14 | 12 | |
| 274 | 39 | 36 | 12:1 |
| 276 | 14 | 12 | |
| 277 | 50 | 48 | ca. 1142 r.p.m. |
| 273 | 14 | 12 | |
| 274 | 42.3 | 40 | 10:1 |
| 276 | 14 | 12 | |
| 277 | 39 | 36 | ca. 1370 r.p.m. |

or similar transmission ratioes within the stated range.

The speed ratio of 7:1 is particularly preferred because it permits greater flexibility for use of the same apparatus as a hobby tool apparatus as shall be explained further below. Speed ratios above 12:1 and below 7:1 have been found unsatisfactory, because the driven shaft then either rotates too fast or too slow for the purpose set forth above, as shall be explained below.

In its forward portion the driven shaft 78 bears forward of its ball, roller or sintered metal bearing 7*a* in upright wall 7 an impact-generating unit 10.

The impact-generating unit 10 comprises a claw coupling comprising two clutch halves of which the rearward half 79 is firmly mounted, for instance by means of a key 78*c*, on the driven shaft 78*a*, while the forward "hammer drum" 80 is mounted axially shiftable on the same shaft and is urged away from the rearward half 79 of the coupling by means of a strong axially acting pressure spring 81. The spring is housed in the hollow interior formed by cavities 79*b* and 80*b* in the adjacent portions of the two clutch halves 79 and 80 and has its one end supported against the inner face of the rear end wall 79*a* of the clutch half 79 and the other spring end is supported against the inner face of the forward end wall 80*a* of the clutch half 80.

The two clutch halves 79 and 80 remain in coupled engagement with each other at all times so as to rotate in unison about the shaft 78*a* regardless of the position of the clutch half or "hammer drum" 80 on this shaft; to this end claws 83 of the rearward clutch half 79 engage claws 84 of the forward clutch half at all times.

Between the forward frontal face 82 of the forward clutch half 80 and the frontal upright wall 8 there is mounted, with its shaft 89, an impact anvil 85 bearing on its rearward disc face 85*a* (see FIG. 4) a diametrically extending rib 86 having sloped flanks 86*a* and 86*b* whose angles of inclination converge from the disc face 85*a* toward the clutch half 80. These flanks 86*a* and 86*b* can be abutted against by two noses or hammers 87 and 88 which protrude from the frontal face 82 of the clutch half 80 and are urged by the spring 81 toward the face 85*a* of the impact anvil 85. Each of these two noses also has sloped flanks 87*a*, 87*b* and 88*a*, 88*b* on its axially extending lateral walls which sloped flanks abut against the sloped flanks 86*a*, 86*b* of the rib 86. The nose flanks 87*a*, 87*b* and 88*a*, 88*b* have been indicated by dashed lines in FIG. 4 because the cross sectional plane IV—IV extends through the untapered foot portions and 88, respectively, and the angles of inclination of flanks in each of these pairs converge toward the face 85*a* of the hammers 87.

The impact disc shaft 89 is supported in a pressed-in gland or a ball roller, or sintered metal bush bearing 90 in the forward upright end wall 8 of the apparatus casing 1 and protrudes from the end wall 8 with a square head end 95. A tool socket 96 or e.g., a wrench having a suitable cavity, for instance of hexagonal cross section whose diameter corresponds to that of a screw, nut or bolt to be loosened or tightened, can be firmly attached to the square head end 95 for rotation with the latter.

The rearward end of the disc shaft 89 ends flush with the top face of the disc rib 86 and contains a cavity 89*a* preferably extending into the shaft zone inside the bearing 90, in which cavity 89*a* there is loosely supported the forward free end of the driven shaft 78*a*.

The operation of the impact unit 10 when loosening a screw nut or bolt having a right hand thread is the following: The tool 96 is placed over the screw nut or bolt. Initially, the spring 81 shifts the loose clutch half 80 in forward direction and the noses 87 and 88 abut with their frontal faces against the rear disc face 85*a*. When the motor unit 11 is switched on, the driven shaft 78/78*a* rotates in the direction of the arrow L (FIG. 4) together with the clutch half 79.

As the claws 79*b* and 80*b* remain in engagement with one another even when the clutch half 80 is shifted forward, the loosely mounted clutch half 80 is taken along and rotates in unison with the clutch half 79. Thereby, the clutch half nose 87 abuts with its leading sloped flank 87*a* (FIG. 4) against the sloped flank 86*a* of the disc rib 86, whereby the former flank "climbs upward" on the latter, while the same occurs also with leading flank 88*a* of the clutch half nose 88 abutting against the sloped flank 86*b* of the rib 86. Thereby the loose hammer drum 80 is shifted slightly in rearward direction, with corresponding compression of the impact drum spring 81 until the hammers 87 and 88 can pass over the rib 86 of the impact disc 85. As rotation of the clutch halves 79 and 80 continues, the spring 81 urges them apart again so that the hammers 87 and 88 are shifted forward, together with their hammer drum 80, toward the impact disc 85. At each revolution of the driven shaft 78/78*a*, the hammers 87 and 88 hit against the disc rib 86 until the screw nut or bolt has become loose enough, under these impacts occurring at a frequency of about 2000 per minute, to follow the rotary movement of the tool 96 on the shaft 89, taking along the impact anvil 85. As soon as this occurs, the anvil 85 rotates in unison with the clutch halves 80 and 79, the impacts cease, and the nut or bolt can be completely removed.

Figure 4:
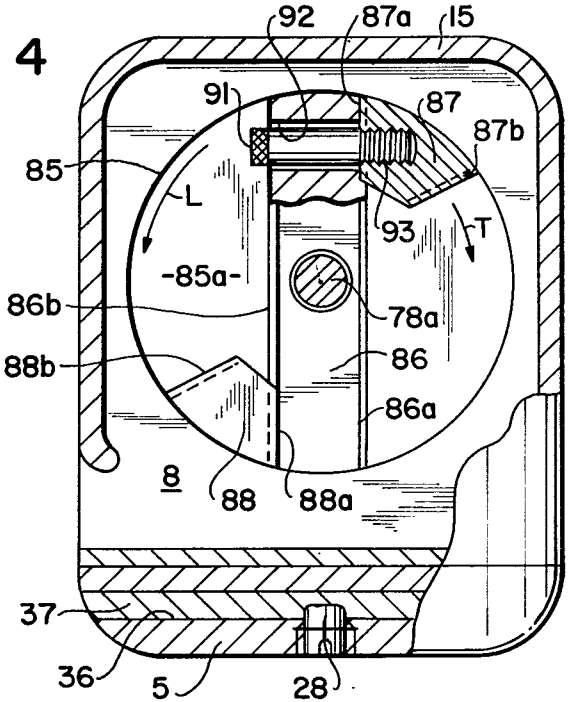
FIG. 4 is a sectional view of the impact unit of the preferred embodiment, taken in the plane indicated by IV—IV in FIG. 1.

Operation in the opposite sense will lead to a tightening of the screw, nut or bolt (arrow T in FIG. 4). If the motor runs at significantly less speed, or the speed reduction is greater than 12:1, e.g. if the motor speed under load drops to 10,000 r.p.m. or lower, for instance due to an automobile battery whose operational voltage has dropped to 10 volts or lower, or if the speed reduction ratio is 14:1 instead of 12:1, the corresponding lower number of impacts has been found insufficient to loosen a severely jammed or seized screw. A drop in the impact frequency will also prevent the hammers 87 and 88 from overcoming the bias of the spring 81.

Surprisingly, I have also found that a motor speed of, e.g. 35,000 r.p.m., corresponding to a driven shaft speed of 5000 r.p.m. when the speed reduction ratio is 7:1, or even of 25,000 r.p.m., if the speed reduction ratio is 5:1, thus yielding a driven shaft speed of about 5000 r.p.m., may also fail to loosen severely jammed screws. It appears that the impact exerted on the disc shaft 89 and on the tool 96 thereon, will then be too weak, as the hammers 87 and 88 will skip over the disc rib 86 and will fail to produce a strong, abrupt impact. Moreover, at higher speeds due to a transmission ratio smaller than 7:1, the same load will impact too much braking power to the motor and too much lever force will be lost in the gear transmission.

When operating the motor with a 24 volt-automobile battery, a motor speed of 27,000 r.p.m. can be obtained. In this case the speed of the driven shaft 78 and the number of impacts on the disc rib 86 will rise to almost 4000 revolutions or impacts per minute, respectively. The same number of impacts can also be attained when the speed of the driven shaft 86 is 2000 r.p.m. and there are four noses provided, equidistantly distributed about the periphery of the frontal face 82 of the loose hammer drum 80. Depending on the degree of jamming or seizing of the screw, nut or bolt to be loosened, this higher number of impacts may work or fail.

Operations of the impact wrench shown in the embodiment of FIGS. 1 to 4 with direct current from a 12 Volt battery (operational voltage 10.5 to 14 volts) affording a motor speed of 13,750 to 15,000 r.p.m. and a transmission ratio of 7:1 affording a speed of the driven shaft 78/78*a* of 2000 r.p.m. and the same number of impacts per minute has been found to be most satisfactory.

In order to obtain a particularly satisfactory operation of the embodiment of the power tool apparatus shown in FIGS. 1 to 4, it hass also been found very advantageous to avoid voltage losses by providing novel on-off and reversing switch means 12.

Figure 6:
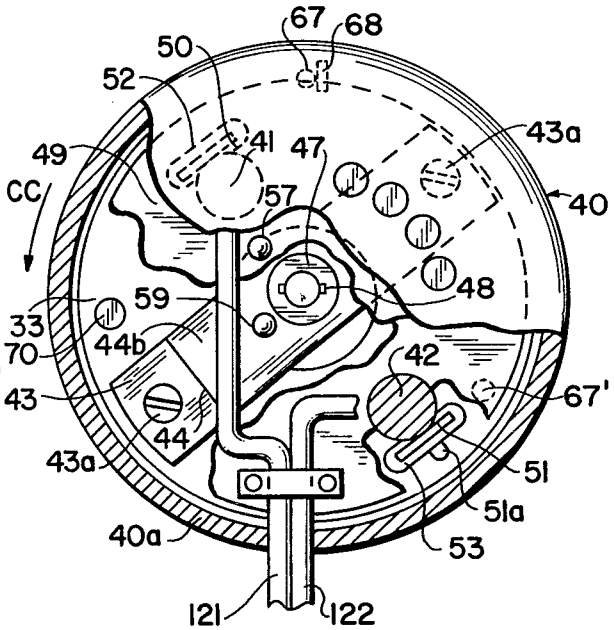
FIG. 6 is a partially sectional view of the same rear end of the motor unit.
Figure 5:
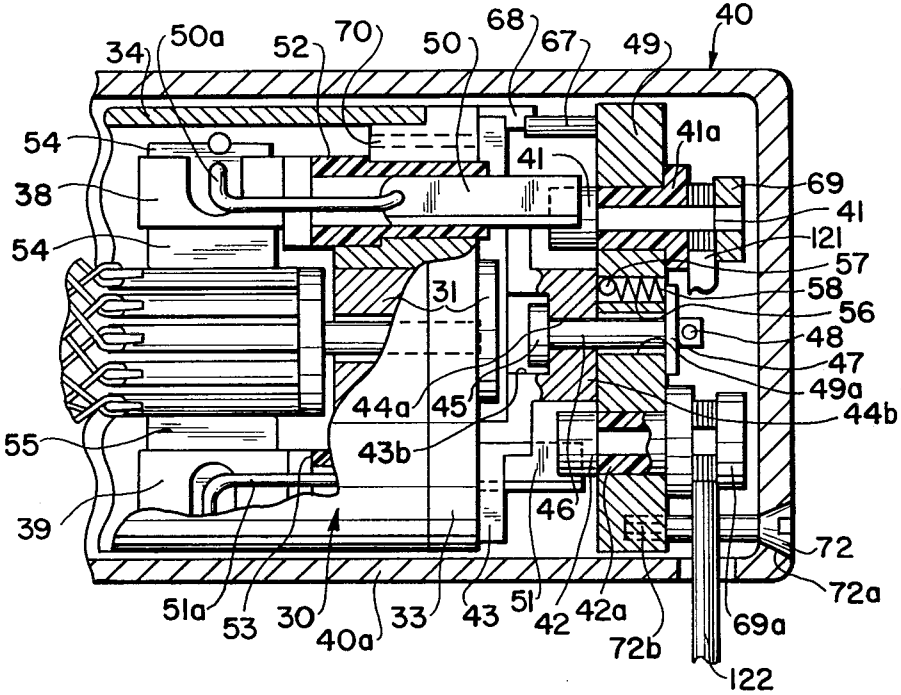
FIG. 5 shows an axially sectional view of the rear end of the motor unit, and an on-off and reversing switch mounted thereon.

A preferred embodiment of such switch means 12 is illustrated in FIGS. 5 and 6. The leads 121 and 122 from the +pole and the −pole, respectively, of a 12 Volt- or 24 Volt-automobile battery are connected to two contactor pins 41 and 42 which are mounted inside a rotatable switch cap 40 on a pins-supporting disc 49, being electrically insulated against the latter by insulating jacket 41*a* and 42*a*. The disc 49 is firmly connected with the switch cap 40, for rotation therewith, by means of one or several connecting flat-head screw bolts 72 inserted through a hole 72*a* in the cap bottom wall 40*a* and screwed into a threaded bore 72*b* in the supporting disc 49. The disc 49 is rotatably mounted on a bridge member 43 which is fastened by means of screws 43*a* on the outside face of the rear end wall 33 of the motor housing 30. The bridge member 43 has on its side facing away from the rear end wall 33 an outwardly projecting raised central bridge portion 44 and a central bore 44*a* therein which registers with the central bore 49*a* of the supporting disc 43 and opens at its forward end in the cavity 43*b* in the face of the bridge portion 44 turned toward the motor housing rear end wall 33. A setbolt 46 having a larger diameter bolt head 45, which rests in the cavity 43*b* extends through the central bores 44*a* and 49*a* and protrudes from the rearward face of the supporting disc 49 where it is fastened by means of a washer 47 and cotter pin 48, thus serving as a shaft about which the pins-supporting disc 49 can be rotated by turning the switch cap 40.

The pins-supporting disc 49 has a further axial bore 56 which opens out of the inward face of the disc 49 where the latter abuts against the rearward face 44*b* of the raised bridge portion 44. A resting ball 57 is lodged in the bore 56 and is urged into contact with the rearward bridge portion face 44*b* by means of a pressure spring 58 also lodged in the bore 56 and being supported at its other end on the underside of the washer 47.

Owing to the above-described arrangement, the switch cap 40 is held rotatably at the rear end of the motor unit 11, with the cap side wall 40*a* enclosing the rearward portion of the motor housing 30. Rotation of the cap 40 about the cap shaft 46 is limited by the stop 67 mounted on the forward face of the pins-supporting disc 49 which abuts, in the position shown in FIGS. 5 and 6 against a first center stop 68, in which position pins 41 and 42 are electrically conductive contact, respectively, with two contactor blades 50 and 51 which are mounted, adjustably in axial direction, in blade bearing means 52 and 53, respectively, which are of electrically insulating material. The contactor blades 50 and 51 are in turn electrically conductively connected via litzes (leads) 50*a* and 51*a* with the commutator brushes 54 and 55, respectively. These brushes 54 and 55 are held in brush holders 38 and 39 of electrically insulating material and slide over the collector segments 24 of the commutator of the electro motor.

Figure 7:
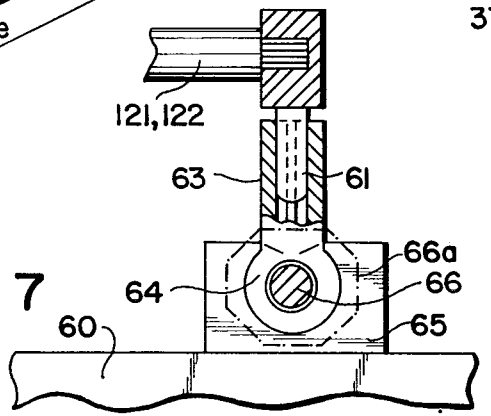
FIG. 7 is a perspective view of novel connecting means for an automobile battery.

Direct electric current is supplied to the motor 12 from leads 121 and 122 which have their one ends connected to the +pole and −pole, respectively, of a direct electric current source, in particular a automobile battery 60 of 12 volts (FIG. 7), while their other ends are fastened, respectively, to the threaded rearward ends of the contactor pins 41 and 42 by means of fastening nuts 69 and 69*a*.

In the position of the switch cap 40 illustrated in FIGS. 5 and 6 the collector segments 24 thus receive direct electric current from lead 121 via contactor pin 41, contactor blade 50 and collector brush 54, on the one hand, and from lead 122 via contactor pin 42, contactor blade 51 and collector brush 55, while upon turning the switch cap by 90° counterclockwise (when looking at the rear end 33 of the motor housing 30 in axial direction), i.e., in the sense indicated by the arrow CC in FIG. 6. When the switch cap 40 has been turned through an angle of 90°, the bore 56 of the supporting disc 49 registers with a small recess or indentation 59 in the rearward bridge portion face 44*b*, which recess is large enough to receive half of the ball 57 therein, thus providing a light arresting position for the switch cap 40, indicating that the switch is in OFF-position.

By further rotating the switch cap 40 counterclockwise, the ball 57 is forced out of the recess 59 against the bias of spring 58 until the stop 67 on the disc 49 abuts against a second counter stop 68*a* thus assuming the position indicated by 67′ in FIG. 6.

This position of the switch cap 40, the position of the contactor pins 41 and 42 is exchanged, pin 41 now making contact with the contactor blade 51, while the pin 42 makes contact with the contactor blade 50. The motor thus receives direct electric current flowing in the opposite direction from the leads 121 and 122 connected to the automobile battery 60, and will accordingly rotate in the opposite sense.

This means that, if the motor turned clockwise, corresponding to the sense of the arrow T in FIG. 4, when the contactor pins and blades made contact in the first described manner, then, with contact established in the last described manner, the motor of unit 11 will be reversed, i.e. it will rotate counterclockwise, in the sense of arrow L in FIG. 4.

The embodiment of an impact wrench apparatus shown in FIGS. 1 to 6 can be easily converted to a hobby tool. This conversion is possible in two ways. According to one mode of conversion, a connecting bolt 91 can be inserted through a transverse bore 92 in the rib 86 of the impact disc 85, which bolt 91 will protrude into a corresponding bore 93 in at least one of the noses 87 and 88, thus eliminating the impact effect and causing the impact disc 85 to rotate in unison with the clutch halves 79 and 80.

Especially in cases where the apparatus embodiment shown in FIGS. 1 to 6 is to be used as a hobby tool most of the time, and its use as an impact wrench is only for a short time at longer intervals, the entire impact generating unit 10 together with the forward casing part 3 of the casing 1, comprising the bottom plate 4 and the upright front wall 8 can be detached from the rearward casing part 2. For this purpose, the driven shaft consists of the rearward shaft 78 and a forward or extension shaft 78*a* which are connected for rotation with each other by a groove 97 and a tongue 98. The shaft 78 is supported by the bearing 7*a* in the wall 7. The separation is then effected by withdrawing the tongue 98 of the extension shaft 78*a* from the groove 97 of the rearward shaft 78 and by also removing the set screws 28 and 29 and thus freeing tongue 37 of the forward bottom plate 4 from groove 36 of the rearward bottom plate 5, whereupon the rearward casing part 2 and the forward casing part 3 can be separated from one another.

Figure 9:
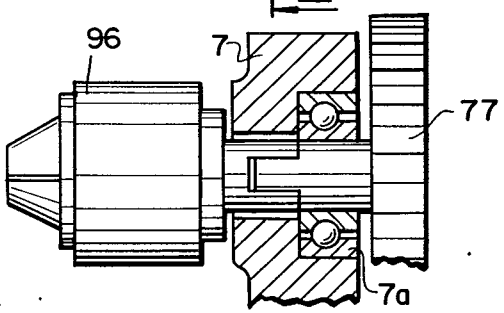
FIG. 9 is a partially sectional view of a detail of a power tool apparatus according to the invention from which the impact-generating unit has been detached.

As shown in FIG. 9, a tool socket 96 can then be attached to the free end of driven shaft 78*a* to receive a hobby tool therein.

In order to insure minimum losses of voltage from an automobile battery 60 to the electric motor in the power tool apparatus according to the invention, multi-copper wire leads having a diameter of 2.5 mm, without the insulating cover layer, and consisting of a strand of fifty copper wires and having each a diameter of 0.25 mm are preferred. The ends of these leads 121 and 122 to be connected to the battery bear connector studs 61 of suitable cross section. for instance, one of the studs 61 can be of square cross section and the other of circular cross section. Each stud 61 is fitted snugly in a correspondingly shaped cavity of plug sockets 63 having as its foot part an eyelet 64 which is attached to, or can be integral with, a forked pole shoe 65 of the car battery 60, which shoe 65 is tightened by a bolt 66 passing through the eyelet 64, and a nut 66*a*.

Figure 8:
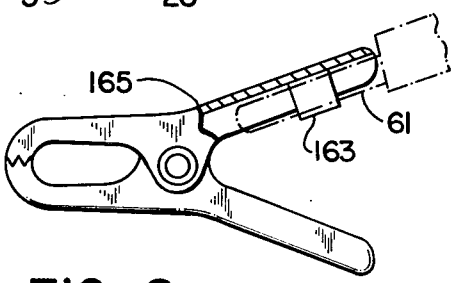
FIG. 8 is a side view of a connecting clamp.

In FIG. 8 there is shown a preferred way of connecting a conventional connecting clamp 165, one of whose legs bears a socket 163 having a bore of suitable cross section into which the appropriate connector stud 61 can be inserted.

Impact drives suitable for use herein are well known and have been described, for instance, in Swiss Pat. No. 553,625 and other publications of Atlas Copco Aktiebolag, Nacka, Sweden.

"Forward" in this description and the appended claims means in the direction toward the tool bearing socket, while "rearward" means in the opposite direction, i.e. toward the rear end of the electric apparatus in the power tool apparatus according to the invention.

While passenger cars usually have wheels attached to their hubs by means of screws or bolts having a wrench width (width over opposite flats of a hexagonal or octagonal nut) of conventionally about 16 to 17 mm, and a prescribed tightening strength of about 120 Nm; rusty, dirty or excessively tightened screws or bolts can demand 150 to 180 Nm for loosening. In the case of trucks (lorries), the nuts or bolts are larger, e.g. of a wrench width of 22 or more millimeters.

The Bosch "Schlagschrauber" (impact wrench) Type 1432 works up to a tightening strength of 180 Nm and uses a speed-reducing gear ratio of about 14:1. My power tool apparatus Type A has at least the same as, or a better tightening strength, and a better loosening strength than, the Bosch Type 1432, but I prefer a 7:1 transmission and require only a 12 Volt car battery, while the Bosch device must be connected to a 220 V A.C. source, e.g. a city main line and has a 14:1 transmission.

In the case of trucks (lorries) which involve tightening strength in the order of up to 350 Nm, the Bosch Type 1432 fails to loosen tightened screws or bolts, a Bosch device of Type 1430 is required. This device has a 50% larger motor and an about 50% heavier impact mass. In the case of trucks (lorries), I prefer to use a 12:1 ratio as speed reduction instead of the 7:1 ratio adopted for passenger cars.

Thus, my tool apparatus achieves loosening of tightened screws or bolts which the Bosch Type 1432 device fails to loosen and for which the much larger, heavier and more expensive Bosch Type 1430 device would be required. While the latter operates with a full load speed of 725 r.p.m. and requires a constant A.C. source of 220 volts and practically limitless current reserves, I achieve the same results, surprisingly, with a tool apparatus according to the invention having a much smaller and weaker motor, at a speed, under full load, of the driven shaft of about 1100 to 1250 r.p.m., drawing current from a D.C. source such as a 12 Volt car battery, or of about 2200 to 2500 r.p.m. drawing current from a 24 volt battery, which is preferably used in that case.

Figure 10:
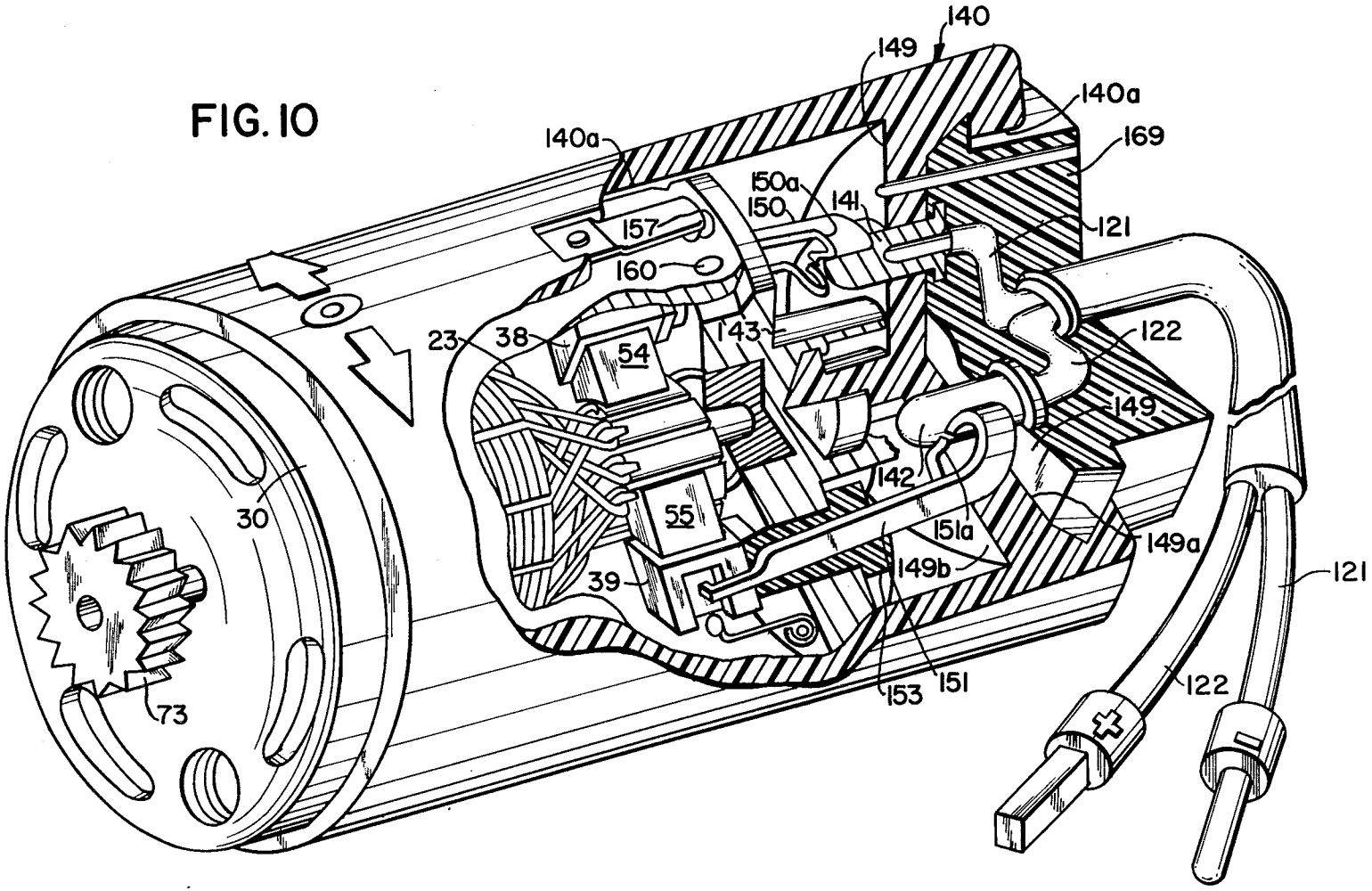
FIG. 10 is a partially sectional view in perspective of the motor unit and another, preferred embodiment of the switching unit according to the invention.
Figure 11:
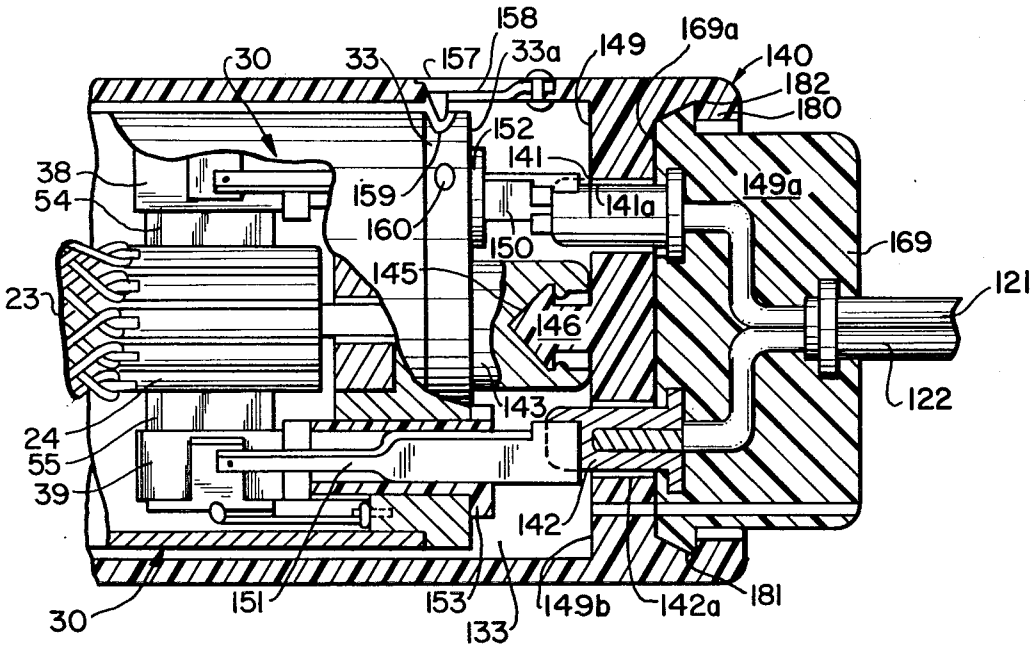
FIG. 11 is a partially axially sectional side view of the rear portion of the embodiment shown in FIG. 10.

In the embodiment of the motor and the on-off and reversing switch means shown in FIGS. 10 and 11, like parts having identical functions are designated by like numerals as in the preceding Figures.

This embodiment is characterized by a particularly simple, sturdy arrangement of the current-conducting parts of the rear portion of the armature and of the switch means. The cap member 140 has a closing wall 149 extending radially with regard to the rotor axis, a lateral cylindrical wall 140*a* and, on the outer face 149*a* of the closing wall 149, a peripheral, inwardly crimped rim 180 surrounding a cavity 181 the bottom of which is constitutes by the outer face 149*a* of the closing wall 149 and which cavity 181 is open toward the outside at the rear end of the power tool apparatus.

The closing wall 149 bears on its inner face 149*b* a central pin 146 having a larger diameter head 145 which is snapped into a corresponding snap-in recess 144 in a socket 143, whereby the cap member 140 is supported for pivotal displacement on the rear end wall 33 of the motor housing 30. The socket 143 protrudes axially from the rearward face 33*a* of the motor housing end wall 33. In the rear end wall 33 there are mounted, in diametrical arrangement with regard to the rotor axis, and in blade bearing sleeves 152 and 153, two contactor blades 150 and 151 which extend into the interior of the motor housing 30 and are electrically conductively connected to the brushes 54 and 55, respectively.

In this embodiment, the use of litzes 50*a* and 51*a* has thus been eliminated, thereby reducing the possibility of power losses. At their free ends the contactor blades 150 and 151 bear resilient, inwardly crimped contact spring parts 150*a* and 151*a* which are contacted by contactor pins 141 and 142 which are snugly lodged in corresponding bores or ducts 141*a* and 142*a*, respectively, in the closing wall 149 of the cap member 140 and protrude through this closing wall 149 axially into the interspace 133 between the inner face 149*b* of the closing cap wall 149 and the rearward face 33*a* of the rearward wall 33. The contactor pins 141 and 142 are firmly embedded in a plug body 169 and protrude from the inner face 169*a* thereof, while leads 121 and 122, which are connectable to the minus and plus terminals of an automobile battery, have their opposite ends likewise embedded in the plug body 169 and have their insulation-free cable ends firmly inserted in the contactor pins 141 and 142 respectively. The plug body 169 is inserted firmly into the cavity 181 and abuts with its frontal face 169*a* against the outer face 149*a* of the closing cap wall 149. The plug body 169 is held firmly in the cavity 181 by means of a laterally projecting annular flange part 182 about the frontal face 169*a* of the plug body 169, which flange 182 is snapped-in and held in position by the inwardly projecting annular rim 180 of the cap member 140.

In the periphery of the motor housing rear end wall 33 there is provided a flat indentation 159 which is engaged by a spring tip 157 being mounted at the free end of a small blade spring 158 which urges the tip 157 into engagement with the indentation 159.

This engagement of the spring tip 157 of the indentation 159 is shown in FIGS. 10 and 11. In this position of all parts of the motor housing rear end wall and switch means relative to each other, the motor will run in a determined sense of rotation, when the leads 121 and 122 are pluged into the minus and plus pole, respectively, of the automobile battery. Current will then flow from the lead 121 through the contactor pins 141, the contactor blade 151 and the brush 54 to the collector segments 24 and the windings 23 of the armature 20.

When the cap member 140 together with the plug body 169 therein and together with the contactor pins 141 and 142 is pivoted about the axis of its central pinvot 146 in the socket 143, the spring tip 157 leaves the indentation 159 and rotation of the cap member 140 is continued until the spring tip 157 enters a next following indentation 160. This may be noticed by a click audible to the user. In this position, both contactor pins 141 and 142 have broken contact with contactor blades 150 and 151, and no current will flow from the automobile battery to the motor.

Upon further pivoting of the cap member 140 about the axis of its central pin 146 in the same sense of rotation, the spring tip 157 will slide on the peripheral surface of the motor housing rear end wall 33 until it enters, preferably with a click into a third indentation (not shown) in which the contactor pin 141 makes contact with a contactor blade 151, while the contactor pin 142 makes contact with the contactor blade 150. Thereby, current will flow from the negative pole of the automobile battery to the brush 55 and from this brush into the windings 23 of the armature 20 and from the brush 54 back to the plus pole of the battery wire lead 122 and the motor will run in the revers sense of rotation.

Even the smaller Type A of the apparatus according to my invention attains tightening torques as high as 300 Nm and more, from a 12 Volt car battery, in the aforesaid case of tightening the nuts or bolts of truckwheels.

Advantageously, in the power tool apparatus according to the invention, a protective layer of corrosion- and electric arc-resistant material, preferably a silver/cadmium oxide alloy having a cadmium oxide content of from about 10 to 15% by weight, is provided on each of the contactor posts and on each contact element.

The silver/cadmium oxide alloy preferably contains 90% by weight of silver and 10% of CdO and has an electric conductivity of 49 ohm/mm$^2$, a melting point above 800° C. and a Vickers hardness of 65. The layer is applied to a copper or silver base by cold impact forming. The lead to the base is of the same metal, copper being preferred.

The above-mentioned silver/cadmium alloys which are suitable for making the contactor posts and contact studs or the like contact-making and -breaking elements in the novel on-off and reversing switch, according to the invention are described for instance in a booklet entitled "DODUCO Silber/Cadmiumoxid Kontakte und Halbzeuge" published prior to 1981 by Dr. E. Dü wächter DODUCO KG, Pforzheim, Germany, and are marketed by the same company under such tradenames as Dodurit CDO 10, 15 etc. wherein, for instance, "10" or "15" indicates the content of cadmium oxide in weight-percent present in the alloy, the balance consisting essentially of silver. The density of these Dodurit CDO alloys ranges from 10.0 to 10.3 and preferably from 10.1 to 10.2.

TESTING OF POWER TOOL APPARATUS

FIRST TEST (COMPARISON)

In a Mercedes Benz truck of the type 1017, the wheels are fastened by means of hexagonal nuts having a wrench width of 32 mm to hub bolts borne by their hubs which bolts have an outer thread diameter of 22 mm. By "wrench width" there is meant the width over opposite flats of the hexagonal nut. The prescribed tightening strength with which these nuts are to be tightened on the hub bolts is 450 Nm. I tightened each tested nut with a strength of ca. 230 to 250 Nm.

In order to loosen the nut, a power tool apparatus according to the invention, on the one hand, and a Bosch "Schlagschrauber" Type 1432, on the other hand, were used. These apparatus had the following data:

| Electric Motor: | Type according to the invention: | Bosch Type 1432: |
|---|---|---|
| Length of Armature: | 65 mm | 270 mm |
| Weight of Armature with Windings and Commutator: | 140 g | 294 g |
| Weight of Magnet: | 80 g | 361 g |
| Reducing Gear Ratio: | 12:1 | 14:1 |
| Weight of Transmission: | identical | |
| Weight of Impact Mass: | identical | |
| Motor Speed idling: | ca. 13500 r.p.m. | ca. 14000 r.p.m. |
| Speed of Driven Shaft under Load: | ca. 1100 r.p.m. | ca. 1000 r.p.m. |

The power tool apparatus according to my invention loosened the tightened nuts without delay and without any noticeable rise in temperature of the motor.

The Bosch apparatus managed to loosen the tightened nuts only with heating of the motor resulting in scorching of the wires as noticeable by the usual smell of their insulation.

The Bosch apparatus was connected as prescribed to a 220 volt electric main; the apparatus according to the invention was connected to a 12 volt automobile battery.

When I tightened the bolts of the above mentioned truck wheels with a strength of about 350 Newtonmeters, the above-described impact wrench according to my invention loosened these bolts without difficulty when using, not the 24 volt of the MERCEDES BENZ truck, but only the 12 volt battery of a Mercedes Benz sedan.

The Bosch Type 1432 impact wrench failed comptably alredy when the bolts were tightened to only 320 Nm.

Even when I tightened the bolts of the Mercedes Benz truck wheels to 450 Nm, I could still loosen them with the above-described impact wrench according to my invention, although the motor showed some smoking indicating considerable heating as loosen of a bolt required 6 seconds.

SECOND TEST

A passenger car Mercedes Type 200 (year 1976) has its wheels fastened with set bolts the head of which has a wrench width of 17 mm while the outer diameter of the threaded parts is 12 mm. The prescribed tightening energy is 120 Nm. The bolts were tightened with 180 Nm. The same power tool apparatus as in Test 1 was used, but with a reducing gear ratio of 7:1. The excessively tightened bolts were loosened rapidly without effort and without any noticeable rise in motor temperature.

THIRD TEST

A Mercedes delivery van Type 409 has its wheel fastened to the bolts of their hubs by means of nuts having a wrench diameter of 19 mm. The prescribed tightening energy is about 200 Nm. The nuts were tightened with 240 Nm.

The same power tool apparatus according to the invention as described in Test 1 was also used in this test. The reducing gear ratio was 12:1 as in Test 1.

The nuts could be loosened rapidly and no rise in motor temperature was noticeable.

The construction of the two power tool apparatus to be compared in the following tests is now compared in order to set forth the combination of structural details which produce an unexpectedly far superior performance of the tested apparatus according to the invention when tightening and when loosening the nuts or bolts of the wheels of a passenger automobile or truck (lorry) respectively equipped with a 12-Volt or a 24-Volt automobile battery.

| | Model No. 9518 Black & Decker all data in mm | Van Laere 12 Volt Apparatus with Motor A |
|---|---|---|
| MOTOR | | |
| Motor housing | | |
| outer diameter | 46.6 | 48 |
| inner diameter | 43.5 | 43.1 |
| Permanent Magnet (Stator) | | |
| length | 37.2 | 31.8 |
| shoe thickness | 4.6 | 48 |
| internal width (space for armature) | 34.3 | 33.4 |
| Armature body (Rotor) | | |
| outer diameter | 32.4 | 32.2 |
| length (=length of straight winding portions) | 28.2 | 26.7 |
| number of gaps (of cutouts) in armature | 12 | 12 |
| Collector and Brushes | | |
| contact surface of brush with collector | 6.1 × 6.1 = 37.2 $mm^2$ | 4 × 8 = 32 $mm^2$ |
| number of collector segments | 6 | 12 |
| outer diameter of collector | 15.5 mm | 14.8 mm |
| number of windings per cutout | 10 | 32–37 |
| Wiring | | |
| wire diameter | 0.9 mm | 0.65 mm |
| litz diameter | 1.2 mm | 1.5 mm |

(litz = reference numeral 50a,51a in FIG. 5)

When operated under less than full load, e.g. for loosening nuts or bolts being tightend with a torque of less than 60 newtonmeters, the power of the Van Laere motor A is expected to be slightly higher because of the larger member of windings, but this is compensated by the larger diameter of the wire used in the known Modell No. 9518 which permits the passage of more current. In operation under less than full load, within the range below.

| Model No. 9518 Black | Van Laere Power Tool Apparatus equipped with Motor A, |
|---|---|

-continued

| | & Decker | supra | |
|---|---|---|---|
| SPEED-REDUCING UNIT | | | |
| gears as shown in FIG. 1 of instant application | 4 | | 4 |
| | | Van Laere Apparatus I | Van Laere Apparatus II |
| Transmission Ratio | 15:1 | 12:1 | 7:1 |
| IMPACTING UNIT | | | |
| impacting hammer drum | | | |
| length | 47 mm | 48.5 mm | 60.5 mm |
| diameter | 57 mm | 52 mm | 52 mm |
| weight | 670 g | 400 g | 480 g |
| hammer shaft | 100 g | 175 g | 200 g |
| drum spring | | identical in both apparatus: | |
| axial length | 36 mm | 40.4 mm | |
| external diameter (envolving cylinder) | 37.7 mm | 39.5 mm | |
| number of windings of spring | about 5 | 5 | |
| diameter of spring wire | 4.3 mm | 5.0 mm | |
| | Model No. 9513 Black & Decker | Van Laere Apparatus I | Van Laere Apparatus II |
| drum spring compressibility of spring compressed: | | | |
| by 10 mm | 14.13 kg | 20.49 kg | 20.49 kg |
| by 20 mm | 33.2 kg | 41.68 kg | 41.68 kg |
| Idling Data | Motor built in apparatus | | |
| | 15:1 | 12:1 | 7:1 |
| Battery Tension | 11.56 volt | 11.56 volt | 11.56 volt |
| idling speed of motor shaft | 17 000 | 14 200 | 12 600 |
| idling speed of driven shaft | 1133 r.p.m. | 1183 r.p.m. | 1800 r.p.m. |
| motor input | 4 amperes | 7 amperes | 6.4 amperes |

FOURTH TEST (COMPARISON)

The test was carried out on a wheel of a Mercedes Benz 280 S passenger car, which wheel bore five screw bolts each having a hexagonal bolt head of a width over opposite flats on 17 mm.

All bolts were tightened by hand using a spanner tool delivered with the car, and the tightening strength was then adjusted with a torque-measuring BRITOOL spanner to a strength of 100 Newtonmeters (75.75 ft. lbs.).

A Black & Decker 12 Volt impact wrench Model No. 9518, was connected to a Bosch 12 Volt car battery of the same car (battery data 66 ampere-hours, 62 amperes) having an actual potential of 11.6 volts, and the impact wrench equipped with a socket tool was then in applied to the bolts to loosen them. The bolts could be loosened only after applying the wrench to a bolt for about 4 to 5 seconds.

The test was then repeated by tightening the bolts successively by hand with the spanner of the accompanying car tools, which spanner had a length of 27 cm, and then adjusting the torque of each bolt to values between 120 and 130 Newtonmeters (88 to 96 ft. lbs.). When trying to loosen the thus tightened bolts with the above-described Black & Decker impact wrench, this wrench failed to do so.

The impact wrench according to the invention being built with a Motor A as described, supra, and a speed-reducing transmission having a ratio of 12:1 loosened each of these bolts within one second, and did also do so when the torque of the tightening was increased successively to 140, 200 and 220 Newtonmeters. In the latter case, power consumption of the tool according to the invention was 1218 Watt (105 amperes).

FIFTH TEST (COMPARISON)

This test was carried out on a wheel of a VOLKSWAGEN "SIROCCO" Type GTi sportscar, which wheel bore five hexagonal nuts each of which had a width over opposite flats of 17 mm. All nuts were tightened by hand and adjusted in the same manner as in the Fourth Test to 90 Newtonmeters (55 ft. lbs.).

The nuts were conically tapered at their undersides turned into the wheel.

The same Black & Decker impact wrench as used in the first test was connected to the 12-Volt battery of the test car. The battery data were 256 amperes and 54 ampere-hours. The wrench was placed with its tool socket on to one of the nuts. The wrench took four to five seconds loosening the nut, as was apparent from a great member of impacts.

When the nuts were tightened to attain torques of 100, 110, 120 and 130 Newtonmeters, the Black & Decker impact wrench failed to loosen the nuts.

In contrast thereto, a novel wrench according to the invention equipped with a Motor A as defined above and a 12:1 transmission ratio was successful in loosening the nuts in about one second in each of the above cases of different tightenings.

SIXTH TEST (COMPARISON)

This test was made with a wheel of a MAZDA 626 LX passenger car bearing five hexagonal nuts having each a width over flats of 21 mm and a flat underside. All five nuts were tightened by hand and adjusted, with the same torque metering spanner used in the Fourth Test, to only 80 Newton-meters. The above mentioned Black & Decker impact wrench was connected to the car battery having a potential of 13.2 Volts and used to loosen the last-described nuts without starting the motor. This wrench was capable of loosening the thus tightened nuts smoorthly When tightened to 90 Newton-meters, it was very difficult to loosen the nut with the above-described Black & Decker impact wrench.

When the nuts were tightened further to 100 and then to 110 Newtonmeters the Black & Decker impact wrench completely failed to loosen them.

These tests were repeated with an impact wrench according to the invention as used in the preceding Fourth to Sixth Tests, equipped with a Motor A and having a speed-reducing gear of the construction shown in FIG. 1 with a speed reduction ratio of 12:1. This wrench loosened the nuts within less than one second even when tightened with a torque of 120 Newtonmeters.

In all tests, the screws tightened with up to 180 Newtonmeter in the case of the Sirocco automobile, and with up to 210 Newtonmeter in the case of the Mercedes and the Mazda automobile were loosened without difficulty by fitting the socket tool at the free end of the driven shaft of the impact wrench according to the invention used in the preceding Fourth to Sixth Tests on to the tightened bolts or nuts of the tested automobile during 0.55 to 0.75 seconds.

The same tests were also repeated with a second impact wrench according to the invention built up from a Motor B as described hereinbefore and a speed-reducing gear of the construction shown in FIG. 1 and having a speed reduction ratio of 7:1.

The same results as with the first-mentioned impact wrench were obtained also with the second impact wrench.

SEVENTH TEST

A steel head screw bolt with a head of hexagonal cross section and a width over opposite flats of the head of 22 millimeters was screwed into a corresponding internally threaded bore in a stationary steel block.

Preliminary Testing of idling speed, current intensity consumed while idling of the Motor A in an impact wrench of the invention as designated below when connected to a 12 Volt Adam Superbat battery, Modell No. 6L6816 66Ah, 330A.

The current consumption at idling was recorded on a curve tracer ACCUCHART manufactured by Fould Inc. Cleveland, Ohio.

The speed of the driving shaft of the idling motor in the tested impact wrench was measured at the driving shaft of the motor mounted in the impact wrench and connected to the 12 Volt-battery.

The impact wrench according to the invention tested was equipped with the Motor A and a gear transmission of the ratio 12:1.

Hexagonal head threaded bolts having a width over opposite flats of 17 mm to 19 mm were to be loosened therewith. The impact wrench was connected to a battery having an effective potential of 10 volts.

The bolts were tightened by hand with a wrench delivered by the automobile company and after each tightening the degree thereof was checked with a BRITOOL torque-measuring wrench.

The results obtained are presented in the following table:

| Width over flats of bolt to be loosened mm | diameter of bolt mm | torque at which bolt was tightened Nm | current consumption of motor Amperes | actual voltage of battery Volts | Effectiveness of Wrench + loosened − failed to loosen |
|---|---|---|---|---|---|
| 17 | 14 | 150 | 22 | 10 | + |
| 19 | 14 | 170 | 24 | 10 | + |
| 19 | 12 | 180 | 24 | 10 | + |

EIGHTH TEST

In order to determine the importance of the transmission ratio range of 7:1 to 12:1 the Apparatus I according to invention was equipped with a four-gear speed-reducing unit having a transmission ratio of 15:1, thus corresponding to the ratio used in the known Model No. 9518 (Black & Decker):

This modified Apparatus I (15:1) could barely loosen the bolts or nuts which were subjected to the Fifth to Seventh Test, when these bolts or nuts were each tightened to 100 Newtonmeters, i.e. approximately the same torque as is loosened by the known apparatus No. 9518.

The results obtained with the novel power tool apparatus are, therefore, particularly surprising and unobvious, as the motors used in the known (15:1)-apparatus and the (12:1)-apparatus according to the invention are practically similar, the difference between the transmission ratioes of 15:1 and 12:1 had not been recognized as significant by the art, and the much lighter hammer of the impacting unit in the apparatus according to the invention would have been expected to be even less effective than the hammer in the Model No. 9518 apparatus which is about 50% heavier.

I claim:

1. An electric rotary power tool apparatus holdable by hand during operation and comprising an apparatus casing consisting essentially of an elongated building block assembly having a longitudinal axis and consisting essentially of (1) a central building block comprising a base element, having a front end, a rear end, (1.1) a first upright vertical wall at said rear end and extending at right angle to said longitudinally axis, and having an opening therein, (1.2) a second upright vertical wall extending at right angle to said longitudinal axis and being spaced forwardly relative to said first vertical wall, said second vertical wall having a bore therein;

(2) a second rearward building block consisting essentially of an electric motor comprising (a) a motor housing comprising a surrounding hull, a forward end wall and a rearward end wall and being mounted on the outside of said first upright vertical wall;

(b) a driving rotor shaft, with a central longitudinal axis therethrough, and extending through the interior of said motor housing and being rotatably supported in said rearward and foreward end walls thereof and extending with a forward shaft end through said opening in said first upright vertical wall, (c) a rotor mounted inside said motor housing on said driving rotor shaft for rotating said shaft, (d) commutator means comprising (d.1) a commutator consisting essentially of collector segments and being mounted on said driving rotor shaft for rotation therewith between said rotor and said rearward motor housing end wall, (d.2) first and second brush means mounted in said motor housing for electrical contact with said collector segments and delivering electric current to said rotor, and (d.3) first and second stationary contactors being electrically conductively connected with said first and second brush means, respectively, said stationary contactors being firmly mounted in said motor housing rearward end wall and having terminal portions having contactable sidewall regions, said terminal portions protruding rearwardly from an outer face of said motor housing rearward end wall and ending in a transverse terminal region therein;

(3) a speed-reducing unit in said central building block;

said speed-reducing unit consisting of a gear train comprising a plurality of gears and a number of transmission shafts each bearing a gear, one of said gears being a pinion mounted on said forward shaft end of said driving rotor shaft, one of said transmission shafts being a driven power-transmitting shaft, said transmission shafts being supported in said first and second vertical walls, respectively.

(4) an on-off and reversing switch being adapted for switching a direct electric current having an electric potential from 8 to 30 volts and an amperage sufficient for affording a power input of said motor of 180 watt and, under load, of 620 watt;

said on-off reversing switch comprising supporting cover means, spaced from and pivotally mouned on said external face of said motor housing rear end wall and having a transverse wall having an inner face extending substantially transversely to said longitudinal rotor axis, and an outer face;

a pair of shiftable contactors each having a lateral contact region and being mounted in said cover means and extending substantially axially relative to said central longitudinal axis from outside said outer face thereof through said cover means transverse wall and protruding from the inner face thereof toward said motor housing rear end wall and into said transverse terminal region therein by a distance such as to extend parallel with said stationary contactor terminal portions by a sufficient length for said lateral contact regions of said shiftable contactors to make contact with said contactable sidewall regions of said terminal portions in axially extending contact zones thereof, when said cover means are angularly pivoted into either one of two limit positions relative to said motor housing end wall, while breaking contact when in at least one intermediate position between said limit positions;

said cover means having passage means for the introduction of a pair of lead means extending from a source of electric energy, into the interspace between said motor hoursing rear end wall and said inner face of said cover means transverse wall, and into electrically conductive engagement with said pair of shiftable contactors, (5) a third forward building block comprising (5.1) a rotary tool holder, (5.2) a driven shaft therefor, and (5.3) connecting means for connecting said driven shaft of said third unit by way of said bore in said second vertical wall with said driven power-transmitting shaft for rotation therewith;

(6) means for detachably fastening said rearward building block in said first vertical wall, and (7) means for detachably connecting said third building block with said central building block, thereby enabling replacement of said second and third building blocks.

2. The power tool apparatus of claim 1, wherein said cover means are cup-shaped and have a cup bottom wall and a circumferential cup sidewall, said cup bottom wall constituting said transverse wall thereof and said cup sidewall extending axially forward toward said first upright vertical wall of said central building block and surrounding a substantial rearward portion of said motor housing.

3. The power tool apparatus of claim 2, wherein said electric motor is a direct current motor comprising (e) a stator being mounted in the interior of said motor housing and being a permanent magnet of magnetic iron material, said permanent magnet comprising a north pole shoe and a south pole shoe of substantially semicylindrical configuration, said pole shoes of said permanent magnet being concentrical with said longitudinal rotor axis; and opposite longitudinal gaps separating said two pole shoes from one another;

said rotor consisting essentially of (i) a generally drum-shaped armature on said rotor shaft and having a substantially cylindrical surface section coaxial with said longitudinal rotor axis, said armature having a number of axially extending cutout channels parallel with said longitudinal rotor axis and opening out of said external surface section of said armature.

(ii) a wiring of electrically conductive wire comprising a plurality of wire portions, each of said channels containing about 30 to 37 of said wire portions, and (iii) said commutator comprising a number of collector segments corresponding to the number of said channels and being mounted on said rotor shaft, said first and second brush means being adapted for collecting, respectivly positive and negative electric current from said collector segments.

4. The power tool apparatus of claim 3, wherein said shiftable contactors are so disposed in said cover means as to be switched by corresponding turning of said cover means to adopt at least three different positions, in a first "off" one of which, parts of said shiftable contactors at the inner face of said cover means are out of contact with both said first and second stationary contactors, while in a second position, a first one of said shiftable contactors makes contact with said first stationary contactor lodged in said rear motor housing end wall on the outside thereof, and the second shiftable contactor makes contact with said second stationary contactor also on the outside of said rear end wall, thereby activating said motor for rotating said driving shaft in a given direction of rotation, and, in a third position, the second one of said shiftable contactors makes contact with said first stationary contactor, and the first shiftable contactor makes contact with said second stationary contactor, thereby reversing the direction of rotation of said motor and said driving shaft.

5. The power tool apparatus of claim 1, 2, 3 or 4, wherein, of two regions consisting of said lateral contact region and said contactable sidewall region a first one comprises inwardly crimped contact spring parts and the other region is pin-shaped so as to be clampingly engagable by the first region.

* * * * *